United States Patent [19]

Sullivan

[11] Patent Number: 4,620,320

[45] Date of Patent: Oct. 28, 1986

[54] SUBSTANTIALLY LEAKPROOF ZIPPER CLOSURE FOR BAGS AND METHOD

[75] Inventor: Brian Sullivan, Shelbyville, Ind.

[73] Assignee: KCL Corporation, Shelbyville, Ind.

[21] Appl. No.: 684,291

[22] Filed: Dec. 20, 1984

[51] Int. Cl.[4] ..... B65D 33/16

[52] U.S. Cl. ..... 383/79; 383/61; 383/81; 493/212; 493/213; 493/214

[58] Field of Search ..... 383/61, 78, 79, 81; 493/212, 213, 214

[56] References Cited

U.S. PATENT DOCUMENTS

| | | | |
|---|---|---|---|
| 2,527,073 | 10/1950 | Port | 383/78 |
| 2,527,074 | 10/1950 | Port | 383/78 |
| 2,978,164 | 4/1961 | Williams et al. | 383/79 |
| 3,000,415 | 9/1961 | Kritchever | 383/78 |
| 3,030,003 | 4/1962 | Schanzle | 383/79 |
| 3,141,601 | 7/1964 | Ayres et al. | 383/78 |
| 3,243,099 | 3/1966 | Winegard | 383/78 |
| 4,241,865 | 12/1980 | Ferrell | 383/61 |
| 4,348,440 | 9/1982 | Kriozere | 383/78 |

*Primary Examiner*—Stephen P. Garbe

*Attorney, Agent, or Firm*—Hill, Van Santen, Steadman & Simpson

[57] ABSTRACT

A hood-like top closure on a bag top has end portions extending beyond opposite sides of the bag and the end portions are closed against leakage. The top closure may have a zipper separably connecting a pair of attachment flanges one of which extends along and is secured to one face of the bag top along the top opening and the other of which flanges is secured to a second face of the bag top along the opening. More particularly, the end portions of the attachment flanges are adhesively bonded so as to prevent sifting or leakage therethrough. A method of and apparatus for making the bag are also provided.

12 Claims, 5 Drawing Figures

SUBSTANTIALLY LEAKPROOF ZIPPER CLOSURE FOR BAGS AND METHOD

This invention relates to the art of reclosable sacks or bags, and is more particularly concerned with bags equipped with zipper closures.

In U.S. Pat. No. 4,241,865 a novel zipper equipped bag closure and method making the same have been disclosed. The zipper closure comprises a hood-like top closure for the bag and provided with a zipper by which the bag can be opened and closed. End portions of the zipper equipped closure extend beyond the opposite sides of the bag body. Sifting or leakage of bagged contents, especially where those contents are of a granular or powdery nature entirely or in part, may occur through the end portions of the closure.

It is to the alleviation of such leakage that the present invention is directed.

An embodiment of the concept of the present invention provides in a bag having a collapsed tubular body with a top providing an opening extending from side-to-side of the bag, a hood-like top closure over the opening and provided with a zipper separably connecting a pair of attachment flanges one of which extends along and is secured to one face of the bag top along the top opening and the other of which is secured to a second face of the bag top along the opening. The attachment flanges have portions extending beyond the opposite sides of the bag, and means are provided for closing the end portions against leakage.

A method of for making the described bag is also provided.

Other objects, features and advantages of the invention will be readily apparent from the following description of certain representative embodiments thereof, taken in conjunction with the accompanying drawing although variations and modifications may be effected without departing from the spirit and scope of the novel concepts embodied in the disclosure and in which.

Figure 1:
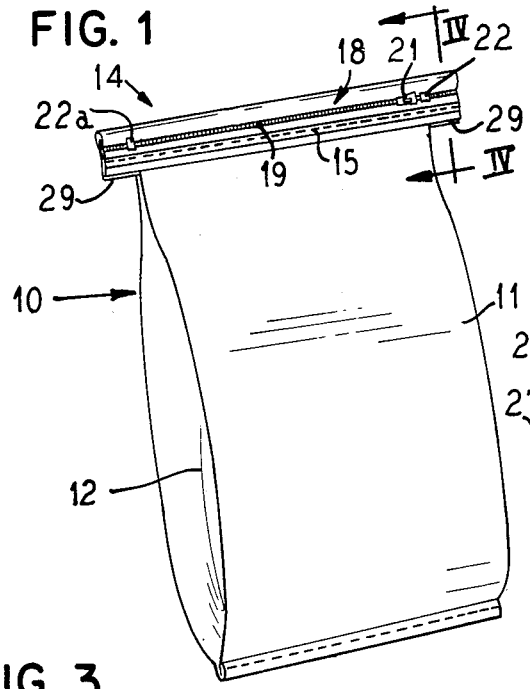
FIG. 1 is a perspective view of a bag embodying the invention.

A reclosable bag 10, as shown in FIG. 1, is depicted as bulged out as though filled with any preferred pourable product and it will be understood that before filling of the bag it will, as is customary be in a collapsed state, which facilitates stacking, storage and handling of empty bags. The body of the bag 10 may be made from many suitable materials which may be one ply or multiply, shown in and herein as multi-ply, paper, heavy duty plastic, or a combination thereof, depending upon the product to be handled by the bag, and cost considerations. In any event, the bag may be of the disposable kind that is intended to be disposed of after the contents have been used, and the bag should be capable of being produced at low cost by mass production methods, substantially as taught in U.S. Pat. No. 4,241,865, which to any extent necessary is incorporated herein by reference.

As shown, the bag 10 comprises a collapsed tubular body which is preferably provided at its opposite sides with gussets 12 (FIGS. 1 and 2) to facilitate expansion of the bag when filled. The bag body 11 will have its bottom end open to facilitate filling the bag, and after filling the open bottom is closed by means of a closure 13 which may comprise any preferred structure such as the lower end of the bag turned over and adhesively secured or stitched closed, or a folded closure strip may be adhesively secured or stitched in place, or the like.

At its upper end, the bag 10, as produced, is provided with a top closure assembly 14 which, in this instance, is constructed and arranged to provide not only a primary closure comprising non-reclosable separable fastener, but also a secondary closure comprising a reclosable fastener. The primary non-reclosable fastener desirably comprises a line of chain stitches 15 across the upper end portion of the bag and with a rip tape strip 17 provided to facilitate pulling the stitches 15 open when the bag 10 is to be opened.

Figure 2:
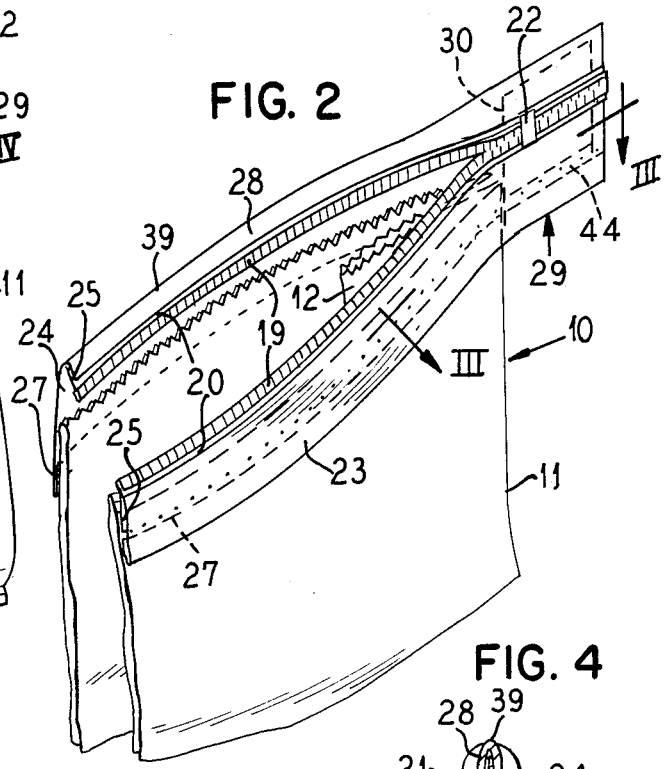
FIG. 2 is a fragmentary perspective view of the top of the bag showing the zipper open.

The secondary closure, and in relation to which the present invention is primarily directed, comprises a hood-like top closure 18 over the top opening of the bag and having a zipper 19 which may be of the chain type having separably interlocking teeth or elements carried on respective stringers 20, and adapted to be opened and closed in well known manner by means of a slider 21. In order to prevent overruning of the slider 21 at the opposite ends of its intended travel along the closure 18, terminal stops 22 and **22*a* are affixed across the zipper 19 at locations spaced apart at least as far as the width of the bag body 11, and preferably slightly greater so as to gain full advantage of the opening through the closure 18 when the zipper is opened as shown in FIG. 2**.

Attachment of the zipper 19 in an operative relation to the top of the bag is effected by means of anchoring strip or tape attachment flanges 23 and 24 to which the stringers 20 are respectively attached as by means of adhesive 25 such as No. 1912-336 thin hot melt synthetic polymer obtainable from Findley Adhesives, Inc. located in Milwaukee, Wis. The attachment flange 23 extends along and is secured as by means of the same kind of adhesive 27 to one face of the bag top along the top opening, and the other attachment flange 24 is secured to a second face of the bag top along the top opening as by means of the adhesive 27 similarly as the flange 23. In this instance, the attachment flange 23 is narrower than the attachment flange 24, and the attachment flange 24 has a return bent upper margin 28 to which its half of the zipper assembly is secured by means of the adhesive 25. This orients the zipper 19 conveniently at what may be considered the front of the bag body 11.

Figure 3:
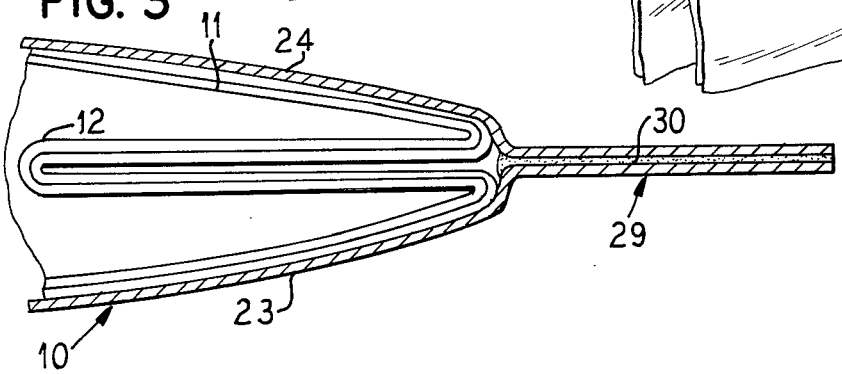
FIG. 3 is an enlarged fragmentary horizontal sectional detail view taken substantially along the line III—III in FIG. 2.
Figure 4:
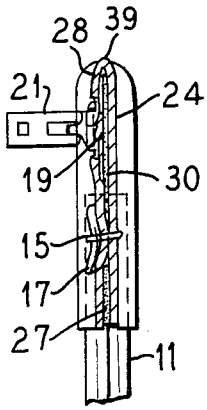
FIG. 4 is an enlarged fragmentary vertical sectional detail view taken substantially along the line IV—IV in FIG. 1.

At each side of the bag 10, the top closure assembly 14 has a portion 29 which extends beyond the adjacent side of the bag. Below the primary closure 15, the attachment flanges 23 and 24 are secured permanently together by the adhesive 27 in the end portion 29. To assure complete closing of the end portions 29 against sifting or leakage, means are provided, conveniently in the form of adhesive 30 which substantially covers the area within the end portions 29 above the adhesive 27. This provides an effective leak preventing seal as will be evident from FIGS. 2 and 3. It will be understood that the length of the end portions 29 will be determined by the spacing between bags 10 as they are produced along a production line as taught in U.S. Pat. No. 4,241,865 and wherein the closure assembly 14 extends as a connecting link between the adjacent bags in the production line and then is severed intermediate contiguous bags to separate the bags one from another.

Figure 5:
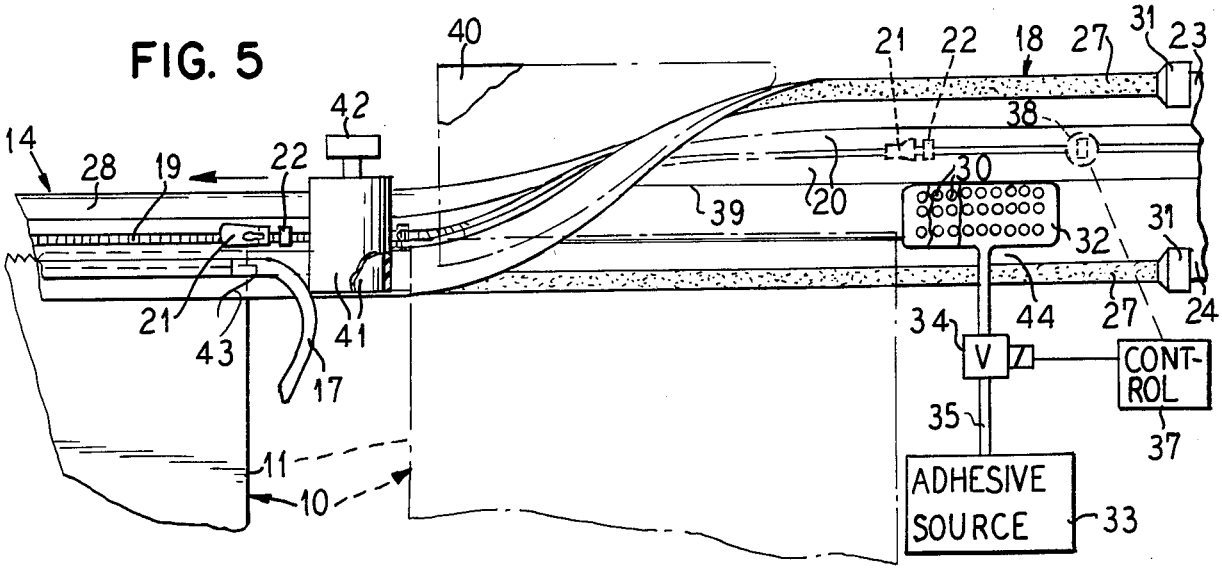
FIG. 5 is a schematic illustration demonstrating certain steps in making of the bag and apparatus for carrying out the method.

Sealing of the end portions 29 by means of the adhesive 30 is adapted to be effected as demonstrated in FIG. 5. Which shows some of the final steps in the production sequence. It will be understood that upstream in such sequence the attachment flanges 23 and 24 will be supplied as ribbon strips from suitable source and adhesively attached to the zipper stringers 20. Then, while the zipper and attachment flanges move as a flat assembly, the adhesive 27 may be applied to the attachment flanges in a suitable manner, such as by means of applicators 31 such as nozzles, or the like. Before or after application of the stripes of adhesive 27, the leakproofing sealing adhesive 30 is applied, preferably to the attachment strip flange 24, in those areas which will become the end extension portions of the closure assembly 14, that is generally in alignment with the portions of the zipper 19 extending in the interval between terminal stops 22 and 22*a* of adjacent bags in the production line.

In a desirable arrangement, the adhesives 30 may be applied under gauged control by spit-spot application by means of a multi-nozzle applicator 32 which receives hot melt adhesive from a source 33. Thereby the adhesive is applied as a uniformly arranged array of spots, such as three rows of nine spots each, on the surface to which applied. The adhesive 30 may be a low viscosity synthetic polymeric adhesive such as that identified as No. HM-1669C obtainable from H. B. Fuller Co. of Blue Ash, Ohio.

Because the adhesive 30 is desired only in the limited, localized areas of the closure assembly 14 between adjacent bags, means are provided for controlling application of the adhesive through the applicator 32 automatically as the closure assembly advances along the production path. To this end, a valve 34 controls supply duct 35 between the adhesive source 33 and the applicator 32 and is under the control of a controller 37 which is responsive to sensor means 38 such as an electric eye. This sensor is responsive to gauging means comprising one of the terminal stops 22 or 22*a*, and in this instance the stop 22*a* which for this purpose is differentiated by color from the stop 22, as by being of a darker color than the stop 22. Thereby, as the sensor 38 detects the stop 22*a* at each interval to receive the adhesive 30, the applicator 32 is activated momentarily to apply the array of adhesive spots.

As the adhesive equipped fastener assembly 18 moves downstream, respective bags 10 are successively assembled therewith and the fastener assembly 18 is folded upon itself along a longitudinal line 39 to fold the attachment strips 23 and 24 onto the respective opposite faces along the top of each bag 10, as by means of a folding device or plow 40 in a manner well known for this type of device. After folding of the assembly 18 has been completed, means such as rubber covered pinch rolls 41 engage the folded closure assembly 18 between them and apply squeezing pressure which effects adhesion of the surfaces which are engaged by the still sufficiently fluent adhesive 27 and 30, and in particular the surfaces of the bags engaged by the attachment flanges 23 and 24, and the confronting surfaces of the attachment flanges which are adhesively secured in leakproof relation in the intervals between adjacent bags. If desired, the pinch rolls 41 may be rotatably driven as by means of a suitable driving means 42 to serve at least in part for advancing the top closure and bag assembly along the production path.

At a suitable location downstream from the pinch rolls 41, stitching means such as an industrial sewing machine (not shown) applies the rip cord stitching 15 from suitable string or thread 43, with the rip tape strip 17 supplied from a suitable source to the sewing site. Although only one set of the pinch rolls 41 has been shown, there may be one such set operating upstream from the stitching site or station and which applies a light tacking pressure to the assembly to avoid possible lateral flow of the adhesive 30 into a relatively adhesive free longitudinally extending alley 44 between the adhesive stripes 27 and the adhesive 30 at each location in order to avoid interference with the stitching operation. Then downstream final pinch roll pressure may be applied to the assembly and which may effect merger of the spots of adhesive 30 and completes the bonding effect of the adhesive 27 and 30.

This finishes assembling of the closure structure 14 with the bags 10, so that downstream from the sewing and bonding station, the bags may be separated one from the other by severance of the substantially leakproofed link sections of the closure assembly connecting one bag to the other in the production line.

It will be understood that variations and modifications may be effected without departing from the spirit and scope of the novel concepts of the present invention.

I claim as my invention:

1. A bag including a collapsed tubular body with a top providing an opening extending from side-to-side of the bag, and comprising:

a hood-like top closure secured to said bag body over said opening and having end portions extending to a substantial distance beyond opposite sides of the bag body;

means closing said end portions against leakage;

said top closure having a zipper separably connecting a pair of attachment flanges one of which extends along and is secured to one face of the bag top along said opening and the other of which flanges is secured to a second face of the bag top along said opening; and said means closing said end portions against leakage comprising adhesive bonding said flanges in said end portions.

2. A bag according to claim 1, including a stitched rip cord extending along and through said flanges, and a narrow substantially adhesive free longitudinally extending alley in said end portions and through which the rip cord stitches extend.

3. A bag according to claim 1, including a stitched rip cord extending along and through said attachment flanges, including said end portions, said attachment flanges being secured to said faces of the bag by means of respective stripes of adhesive below said rip cord and which stripes of adhesive extend along said end portions and comprise part of said bonding adhesive, the remainder of said bonding adhesive securing said attachment flanges in said end portion above said rip cord, and there being a narrow substantially adhesive free alley for the rip cord in said end portions.

4. A bag according to claim 1 including a reclosable zipper along said top closure and which zipper has a slider, slider stops across said zipper adjacent to the sides of the bag, said end portions extending beyond said stops, and said closing means adhesive bonding said flanges together between said stops and the respective free ends of said end portions.

5. A method of making a bag, comprising:

providing a collapsed tubular bag body with a top having an opening extending from side-to-side of the bag;

supplying a hood-like top closure over said opening;

effecting projection of opposite end portions of said top closure beyond the opposite sides of the bag;

providing said top closure with a zipper separably connecting a pair of attachment flanges;

assembling and securing one of said attachment flanges to one face of the bag body top along said opening and assembling and securing the other of said flanges to a second face of the bag top along said opening; and adhesively bonding the portions of said flanges which are in said end portions whereby to effect closing of said end portions against leakage.

6. A method according to claim 5, which includes providing a narrow substantially adhesive free longitudinally extending alley in said end portions, and stitching a rip cord along and through said flanges and along said alley in said end portions.

7. A method according to claim 5, comprising stitching a rip cord along and through said attachment flanges including said end portions, attaching said flanges to said faces of the bag by means of respective stripes of adhesive below said rip cord and extending along said end portions as part of said adhesive bonding of said end portions, effecting the remainder of said adhesive bonding of said end portions by adhesively securing said attachment flanges in said end portions above said rip cord, and providing a narrow substantially adhesive free longitudinally extending alley between said adhesive below and above said rip cord in said end portions.

8. A method according to claim 5, which comprises providing said zipper with a slider, providing slider stops across said zipper adjacent to the sides of the bag, extending said end portions beyond said stops, and effecting said adhesively bonding said flanges together in said end portions between said stops and the respective free ends of said end portions to effect said closing.

9. A method according to claim 5, which comprises applying said adhesive as an array of adhesive spots, and squeezing said flanges together and generally merging said adhesive spots for effecting said bonding.

10. A method according to claim 5, which comprises after adhesively bonding said opposite end portions for effecting said closing, stitching a rip cord to extend along said top closure.

11. A method according to claim 5, which comprises effecting said adhesive bonding by applying said adhesive selectively to said end portions, and gauging the adhesive application in response to gauging means on said top closure.

12. A bag including a collapsed tubular body with a top providing an opening extending from side-to-side of the bag, and comprising:

a hood-like top closure secured to said bag body over said opening and having end portion comprising confronting flanges extending to a substantial distance beyond opposite sides of the bag body;

a stitched rip cord extending along said top closure and through said flanges;

said flanges having opposed interfaces;

a stripe of adhesive securing said interfaces together below said rip cord;

additional adhesive securing said interfaces together above said rip cord; and a narrow substantially adhesive-free alley along said interfaces and between said stripe and said additional adhesive and along which alley said rip cord extends, so that along said alley the stitches of the rip cord are free from objectionable adhesive contamination.

* * * * *